United States Patent [19]

Newman

[11] 3,973,067

[45] Aug. 3, 1976

[54] SHORT-FIBERED NONWOVEN FABRICS

[75] Inventor: Nicholas S. Newman, Cohasset, Mass.

[73] Assignee: The Kendall Company, Boston, Mass.

[22] Filed: Oct. 18, 1974

[21] Appl. No.: 515,879

Related U.S. Application Data

[60] Continuation-in-part of Ser. No. 438,189, Jan. 31, 1974, abandoned, which is a division of Ser. No. 206,410, Dec. 9, 1971, Pat. No. 3,816,159, which is a continuation-in-part of Ser. No. 144,607, May 18, 1971, abandoned, which is a continuation-in-part of Ser. No. 831,564, June 9, 1969, abandoned.

[52] U.S. Cl. ..... 428/195; 428/288; 428/302

[51] Int. Cl.[2] ..... B32B 7/14

[58] Field of Search ..... 161/146–148, 161/150–152, 153–156, 157–165, 170–181, 64, DIG. 2; 156/62.2, 62.8, 279; 428/90, 198, 195, 288, 297, 298, 302

[56] References Cited

UNITED STATES PATENTS

| | | | |
|---|---|---|---|
| 3,336,183 | 8/1967 | Larner et al. | 161/DIG. 2 |
| 3,462,326 | 8/1969 | Steel et al. | 161/64 |
| 3,573,121 | 3/1971 | Fukada et al. | 161/DIG. 2 |
| 3,669,823 | 6/1972 | Wood | 161/156 |
| 3,822,174 | 7/1974 | Hefele | 161/DIG. 2 |
| 3,853,608 | 12/1974 | Hammer et al. | 161/DIG. 2 |

*Primary Examiner*—James J. Bell
*Attorney, Agent, or Firm*—Edward J. Scahill, Jr.

[57] ABSTRACT

Nonwoven fabrics of improved abrasion resistance are produced by applying to a dry-laid fibrous web an aqueous dispersion of ultra-short fibers of 50 to 300 microns in length, said ultra-short fibers being coated with a polymeric binder and being suspended in an aqueous phase which is substantially free of binder. The dry-laid fibrous web may be bonded in a separate operation, optionally with a different polymeric binder and in a discontinuous pattern.

6 Claims, 4 Drawing Figures

SHORT-FIBERED NONWOVEN FABRICS

This application is a continuation-in-part of my copending application Ser. No. 438,189, filed Jan. 31, 1974 now abandoned, which in turn was a division of my patent application Ser. No. 206,410, filed Dec. 9, 1971, now U.S. Pat. No. 3,816,159, which in turn was a continuation-in-part of my patent application Ser. No. 144,607, filed May 18, 1971, now abandoned, which in turn was a continuation-in-part of my patent application Ser. No. 831,564, filed June 9, 1969, now abandoned.

This invention relates to a process for the preparation of bonded nonwoven fabrics, and the products thereof. More particularly, it relates to the preparation of medium or lightweight nonwoven fabrics of high opacity and high abrasion resistance, suitable for fashioning into items such as disposable or limited-use garments.

Bonded nonwoven fabrics, comprising dry-assembled, textile-length unspun and unwoven fibrous webs bonded by polymeric binding materials, are produced by a variety of processes and are staple articles of commerce. In addition to numerous industrial applications, they are finding increasing use in the field of disposable items such as garments, sheets, pillowcases, surgical drapes, and the like. Conventional nonwoven fabrics, however, are planar and uniform, not closely resembling the woven fabrics which they are intended to replace. Additionally, and of paramount importance in disposable clothing, sheets, and drapes, conventional nonwoven fabrics of a weight range which may economically be used are undesirably translucent, and lack covering or concealing power.

Attempts have been made to remedy this translucency by embossing the surface of the nonwoven fabric, or printing design thereon, to increase the light-scattering effect. Such attempts are expensive and of limited utility. Recourse has also been had to the use of highly delustered fibers, such as viscose rayon fibers with abnormally high titanium dioxide contents. The opacity and dullness of such fibers reaches a limit, however, at a rather low level of pigment content, and the increase in opacity of nonwoven fabrics produced therefrom is marginal. The same is true of attempts to opacify nonwoven fabrics by adding clay or other fillers to the binder used to unify the fibrous structure.

It has also been proposed to deposit a layer of papermaking fibers, 1,000 microns or more in length, upon a web or fleece of textile-length fibers. Due to the length of papermaking fibers, however, and perhaps also in part to their swollen and hydrated condition, papermaking fibers tend to filter out onto a web of textile-length fibers without penetrating into the web sufficiently to form a satisfactory interlocking bond with the textile-length fibers. Furthermore, hydrated and fibrillated papermaking fibers tend to dry down to a rather stiff sheet, with an undesirable hand, due to the formation of papermakers' bonds.

It is also known to combine papermaking fibers with textile-length fibers in a conventional papermaking machine, using a headbox and inclined Fourdrinier screen. The equipment needed, however, is very expensive compared with the equipment used in processing nonwoven fabrics, and the processing is also expensive and slower than normal papermaking since very low concentrations of fiber, down to 0.01% fiber content in water, must be used.

In my earlier patent, U.S. Pat. No. 3,616,180, there is described a process for producing nonwoven fabrics of increased opacity. Basically, the steps involved in that process comprise:

1. Assembling textile-length fibers into a dry, unspun and unwoven web as by means of cards, garnetts, air-lay-devices, or the like.
2. Saturating the fibrous web with an appropriate binder solution containing ultra-short fibers suspended therein in dilute concentration, said ultra-short fibers being substantially unbeaten, unhydrated, and uniformly distributed in a non-agglomerated condition.
3. Mechanically removing a major portion of the binder solution from the web while leaving the ultra-short air-lay devices, upon and within the web.
4. Completing and drying of the bonded nonwoven fabrics.

The procedure set forth immediately above results in nonwoven fabrics wherein the opacity is increased from a value of 0.40 – 0.45 to value of 0.60 – 0.70, as measured by a Bausch and Lomb Opacimeter 33-88-12, according to Textile Research Journal, Volume 38, No. 1, January, 1968, page 8. For certain apparel uses, however, and for other uses where the nonwoven fabric is subjected to repeated frictional contact with itself or with another rubbing surface, products formed in the above manner are found deficient in abrasion resistance.

Moreover, since the binder dispersion in which the ultra-short fibers are suspended serves to bond both the ultra-short fibers and the underlying fibrous web, the versatility of the above process is limited. In many cases it may be deemed desirable to bond the ultra-short fibers into a cohesive surface layer with a first binder that is firm and tough, while bonding the other underlying fibers with a second binder of quite different characteristics.

Also, the process of U.S. Pat. No. 3,616,180 results in an overall saturation of both the ultra-short fiber fraction and the underlying fiber fraction. It is recognized that for maximum flexibility and softness, it is often desirable to bond a web of fibers discontinuously — that is, in a pattern of separate or interconnected spots, lines, or geometric figures, so that while every fiber is bonded one or more times along its length, there remain substantial lengths of unbonded fibers which are free to flex or move laterally.

Finally, the process of U.S. Pat. No. 3,616,180 in common with most binder saturation techniques, necessitates a complicated recovery system for reclamation of excess binder applied to the web, in order to be economically feasible.

The process described below is intended to overcome the above disadvantages, and to yield nonwoven fabrics of improved characteristics.

It is therefore an object of the present invention to provide opacified nonwoven fabrics of enhanced flexibility and resistance to abrasion.

It is an additional object of the invention to provide a process for nonwoven fabrics comprising at least one substrate of dry-laid fibers and a superposed layer of ultra-short fibers where the two species of fibers are bonded in separate operations with different binders.

Another object of the invention is to provide a novel process for bonding nonwoven fabrics which involves no binder recovery system.

Other objects of the invention will be better understood from the following description and drawings, in which.

Figure 1:
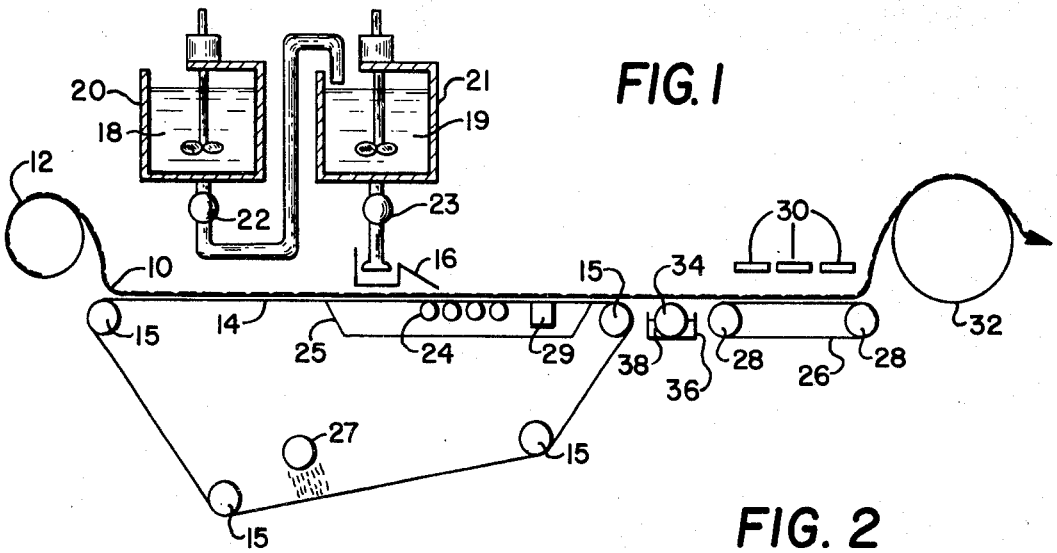
FIG. 1 is a schematic representation of an apparatus suitable for conducting the process of the invention.

The process of the present invention comprises the following steps:

1. Forming an aqueous suspension of substantially unbeaten and unhydrated ultra-short fibers in a dispersion of a first polymeric binder.

2. Exhausting the binder in the suspension to substantial completeness onto and in the ultra-short fibers until the water phase is substantially free of binder.

3. Forming an open, porous, substantially unbonded fibrous web of dry-laid textile length fibers or filaments.

4. Applying to the fibrous web the binder-containing ultra-short fibers.

5. Mechanically removing a major portion of the substantially binder-free water phase while leaving the binder-enriched ultra-short fibers at and near the upper surface of the web.

6. Bonding the dry-laid fibers or filaments in a separate bonding operation with a separate and different binder.

7. Completing the drying of the fabric.

As an optional additional step, if a product is desired which has a deposit of ultra-short fibers on both faces, the product after step 6 above may be mechanically reversed and steps 4, 5, and 7 repeated.

By dry-laid fibers is meant here fibers of textile length, capable of being carded or garnetted; shorter fibers, unfibrillated and unbeaten, adapted for dry deposition in an air-lay device, and mixtures thereof. Textile length fibers, usually one-quarter to 6 inches in length (6,250 to 150,000 microns) may be cotton, staple rayon synthetics, mixtures thereof, and the like. Shorter fibers, down to papermaking length (1,000 – 3,000 microns), may be used alone or in admixture with textile-length fibers, provided that the shorter fibers have not been beaten or fibrillated, and are incapable of forming a paper-maker's bond. Methods for forming dry-laid webs from such fibers, by an air-lay process, are set forth, for example, in Canadian Pat. No. 813,290.

By ultra-short fibers is meant herein fibers which are below the length of papermaking fibers and which for the purposes of this invention are not beaten, hydrated, or fibrillated to any substantial degree, and therefore are also incapable of forming what is known as a paper-makers' bond. Suitable fibers would average from 50 to 300 microns in length, and may be typified by bleached ground or knife-cut wood pulp which has fibers of varying lengths distributed over that range, or by specially porcessed ultra-short cellulosic fibers known as Solka-Floc, a trademarked name for purified wood cellulose fibers supplied by the Brown Company. In the latter case, the length of the ultra-short fibers is closely grouped around a mean, and mixtures of fibers of different lengths may be used.

By a substantially unbonded fibrous web is meant a web which is either completely unbonded, such as a web of fibers as delivered from a card, garnett, or air-lay machine, or a similar web which is so lightly bonded that its porosity and fiber freedom are substantially unaltered. This latter alternative is desirable in cases where it is not convenient to mount a web-forming apparatus ahead of the wet section of the process, and where transporting and unwinding the web requires a certain low degree of coherence between fibers. In general, such light bonding may be effected by the use of 5% or so of a bonding agent, or by mingling with the textile-length fibers a small percentage of thermoplastic fibers and subjecting the web to heat to develop autogenous fiber-to-fiber bonds, or by other conventional methods.

Also included in the definition of substantially unbonded fibrous webs are webs of continuous filaments, such as are produced by extruding filament-forming polymers directly from a bank of spinnerets and intermingling them on a conveyor belt. Such webs may be unbonded, or more preferably the filaments may be bonded to each other at at least two of their points of intersection. Whatever the nature of the substrate, it is desirable that it be basically an open and porous network, free of resist spots which impede the free passage of water therethrough, and characterized by an air porosity of at least 150 cubic feet of air per minute per square foot of product at one-half inch hydrostatic head.

The process may be illustrated by reference to FIG. 1, which is schematic and not to scale. A web of unspun and unwoven fibers 10 is delivered from a supply roll 12 to a porous conveyor screen 14 driven by guide rolls 15. Alternatively, the web 10 may be delivered directly to the screen 14 from an assembly of cards, garnetts, or air-lay machines.

The fibrous web is advanced by the conveyor screen 14 to pass underneath a flooder box 16, so arranged that a constant fluid-suspended sheet of ultra-short fibers, coated with a film of a first polymeric binder, is deposited on the web. The flooder box is fed from a supply tank 21, in which the binder-coated ultra-short fibers are kept in even suspension 19 by means of constant agitation. The rate of feed of the suspension to the flooder box is controlled by the valve 23.

For heavy deposits, or for the deposition of ultra-short fibers of different lengths or ultra-short fibers associated with different binders, a plurality of such flooder boxes may be used.

The supply tank 21 in turn is supplied with a dilute suspension of binder-coated fibers from a reaction tank 20 by means of the pump 22. For batch processing, the tank 20 is of sufficient capacity to supply all of the ultra-short fiber needed for the desired run of fabric. Alternatively, in continuous processing a multiplicity of tanks 20 may be used, so that the binder-exhaustion process may be completed in a stand-by tank while another tank is feeding binder-coated fibers to the tank 21. The binder-exhaust process will be described separately below.

From the flooder box 16 the web is advanced to a section where excess water is removed, said water being substantially free of binder due to the particular nature of this process. For most purposes, this extraction of water may be effected by one or more suction boxes 29. For high speed operation, the action of the suction box 29 may be supplemented by a set of table rolls 24, as shown. Such rolls, as used in the paper industry, revolve against the lower surface of the screen 14 which supports the web, and thus exert a wiping action or even a gentle suction which removes a substantial part of the water, thus expediting subsequent drying.

The water thus removed is drained to a sewer, with the interposition of a settling tank if desired. In cases where it is desired to recover any ultra-short fiber content in the white water a conventional recovery and make-up system, not shown, may be employed.

The scrren 14, driven by guide rolls 15, may be washed free of any fiber or debris, if desired, by means of a water spray 27. It is an advantage of this process that there is little or no contamination and clogging of the screen by the polymeric binder.

As this system is processed, it is necessary to carry out a second bonding operation to bond the fibers of the dry-laid base web with a second and different polymeric binder, which otherwise would be quite fuzzy and abrasion-susceptible on its lower surface. This may be accomplished in a variety of ways, as by including thermoplastic binder fibers in the base web, with subsequent exposure to heat. An equally convenient process is shown in FIG. 1, where the unbonded lower surface of the web is passed over a print roll 34, revolving in a trough 36 of a polymeric binder 38, whereby a pattern of polymeric binder is applied to the web, as explained more fully below.

Subsequent drying, and the completion of the setting of the binder or binders, may be accomplished by transferring the web to an auxiliary screen 26, driven by drive rolls 28, upon which it passes under infrared heaters 30. The final drying may be accomplished by a steam-heated dry can 32, or a multiplicity thereof. The drying process is not oritical, and various other drying expedients may be employed.

PREPARATION OF BINDER-COATED ULTRA-SHORT FIBERS

Basically, the steps involved in exhausting non-ionic polymeric binders onto ultra-short fibers resemble the process in use for exhausting such polymeric binders onto papermaking fibers by beater addition, or as set forth in U.S. Pat. No. 2,601,598 to Daniel et al and 2,765,229 to McLaughlin. An aqueous suspension of fibers is formed, with the aid of a dispersing agent if desired; an aqueous solution of a polyelectrolyte is added, and agitation is continued until the polyelectrolyte has been absorbed or adsorbed by the fibers; an aqueous dispersion of a first polymeric binder is then added and agitation is continued until the clarity of the water phase indicates that substantially all of the polymeric binder is attached to the solid fiber phase.

As a specific example of the preparation of 100 gallons of 1% ultra-short fiber stock coated with an acrylic binder, the following steps are taken:

1. To 35 gallons of water in an agitated tank of 100 gallon capacity or more there are added 8 grams of a non-ionic wetting agent, such as TRITON X100 (Rohm and Haas trademark for an alkyaryl polyether alcohol), and agitation is continued until the wetting agent is dispersed: The use of the wetting agent assists in the dispersion of the ultra-short fibers added subsequently.

2. 3,785 grams of Solka-Floc BW40 (average particle size being approximately 90 microns) are added to the solution and are agitated for 10 minutes to insure thorough dispersion.

3. The pH of the suspension is adjusted to 8.0 using a solution of sodium hydroxide.

4. 3,750 grams of a 1% solution of a polyelectrolyte such as Lufax 295 (Rohm and Haas trademark for a salt of a complex polyamine) are added to the fibrous suspension, agitation is continued for 5 minutes, the pH is lowered to 4.5 using hydrochloric acid, and agitation is continued for 10 more minutes.

5. 1270 cc. of Rhoplex HA-8 and 665 cc. Rhoplex K-3 (both Rohm and Haas trademarks for non-ionic polyacrylic emulsions) are diluted with water from their 46% solids content to 10% solids, after which they are slowly added to the fiber suspension.

6. Agitation is continued for 10–15 minutes, preferably until filtration of a sample of the suspension through No. 1 Whatman filter paper yields a water-clear filtrate, indicating complete exhaustion of the acrylic binder onto the ultra-short fibers.

7. The volume of the suspension is then brought to 100 gallons by the addition of water; preferably a dispersing agent, such as TRITON M100 (Rohm and Haas trademark for a nonylphenol) in the amount of 0.1% – 0.2% of the fiber weight, is added to insure stability of the suspension and rapid wetting of the underlying web of dry-laid fibers.

8. For convenience in operation, a colloidal defoaming agent, such as COLLOID 581B (Colloids, Inc. trademark for a dispersion of metallic soaps in emulsifiers), is added and mixed with the stock solution, in the amount of 0.1% – 0.2% of the fiber weight.

A process of this sort has been found to produce a binder-coated suspension of ultra-short fibers free from agglomeration and free from polymer particles not associated with fibers.

Alternatively, anionic binders may be substantially quantitatively exhausted onto ultra-short fibers, as by the following procedure.

To a dispersion of 180 pounds of Solka Floc BW40 in 300 gallons of water, containing a trace of wetting agent, there were added 230 grams of Fixing Agent FP (BASF tradename for a formaldehydeamide condensation product) in 2.5 gallons of water. After 15 minutes, 20 gallons of ACRONAL 35D (BASF tradename for an anionic acrylic latex), of 25% concentration, and containing 1900 cc. of 10% Hercosett 57 (Hercules tradename for a polyamide-epichlorohydrin polyectrolyte) diluted with 2 liters of water, were added.

After 15 minutes standing, a filtered sample of the suspension gave a clear water phase, indicating exhaustion of the binder polymer onto the ultra-short fibers. A trace (0.01%) of defoaming agent and an equal amount of a surfactant, such as TRITON DF-12 (Rohm and Haas trademark for a polyethoxylated alcohol) were added, and the volume of the suspension was adjusted to 400 gallons.

Although on a theoretical basis cationic binders should exhaust onto ultra-short cellulosic fibers, in the absence of a polyelectrolyte the anionic charge borne by the fibers is of such a low potential that commerically available cationic latices are only slowly exhausted. In the use of cationic latices, therefore, it is desirable to choose a latex with a relatively high percentage of cationic groups, and to select a highly stable latex to guard against coagulation.

Other methods of binder exhaustion onto ultra-short fibers will readily occur to those skilled in the art.

Figure 3:
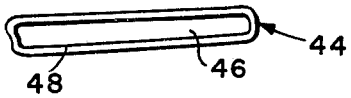
FIG. 3 is a still more highly magnified view of one of the ultra-short fibers of FIG. 2.

The ultra-short fibers thus prepared are represented in schematic cross-section in FIG. 3, where a fiber 44 is shown as having a central cellulosic core 46 and a coating or adsorbed layer 48 of polymeric binder.

It is an advantage of the process of this invention that concentrations of 1% to 4% of ultra-short fibers in water may be employed to flood onto the fibrous substrate, thus offering economies in the handling and disposal of the aqueous phase. By contrast, the concentration of beaten and hydrated papermaking fibers may range from 0.1% down to 0.01% in conventional techniques for combining papermaking fibers with textile-length fibers. In general, fabrics made by the process of this invention require less than 5% of the water consumption, and associated handling apparatus, which are required for fabrics of similar weight using conventional papermaking techniques. In the present invention, it has been generally found that when the concentration of ultra-short fibers reaches 5% or more in the aqueous suspension, the viscosity of the suspension is so high that a smooth and even flooding process becomes difficult.

A wide variety of polar polymeric bonding agents may thus be exhausted onto the ultra-short fibers, the acrylic and vinyl dispersions being exemplary. Depending on the nature of the binder and on the particular effect desired, from 5% to 100% of binder (dry basis) may be exhausted onto a given weight of ultra-short fibers.

EXAMPLE 1

Using the procedure set forth above, a 100 gallon stock suspension of binder-coated ultra-short fibers was applied to a card web of 50% 1.5 denier — 50% 3 denier rayon fibers weighing 25 grams per square yard. After drying, the coated web weighed 56 grams per square yard, consisting of 25 grams of textile-length fibers, 22 grams of ultra-short fibers, and 9 grams of acrylic binder, with the binder substantially confined to the ultra-short fiber layer covering the textile-length fibrous web. The textile-length fibrous web was adherent to the unified coating of ultra-short fibers, but was not bonded internally, being soft and fuzzy. It was given substance and integrity by a secondary line-bonding operation with a second, different and firmer acrylic binder, i.e. a binder having more cross-linkage therein, or the like.

Figure 2:
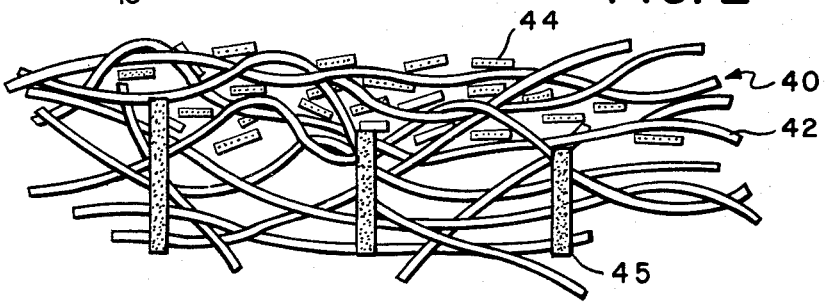
FIG. 2 is a cross-sectional representation of a preferred product of the invention.

The bonded assembly 40 is represented in FIG. 2, wherein the rayon fibers 42 are shown as inermingled at and near the top surface by the binder-coated ultra-short fibers 44, and wherein the secondary set of bonding lines 45 gives strength and integrity to the rayon web.

This material, Example 1, was then compared in properties with a similar material containing ultra-short fibers, Example 2 of the process set forth in U.S. Pat. No. 3,616,180 in which the ultra-short fibers were merely suspended in the acrylic binder dispersion which was then flooded onto the web of textile-length rayon fibers in a manner such that the binder also was deposited on the web. Example 2 of U.S. Pat. No. 3,616,180 weighed 62 grams per square yard.

In tensile strength, tear strength, and elongation both samples were on the average substantially comparable and were satisfactory for use as disposable nonwoven graments in drape and hand. The opacity of Example 1, however, was 0.75 to 0.80, a definite improvement over Example 2 which rated 0.65 – 0.72, both measured on the Bausch and Lomb Opacimeter mentioned above.

Even more pronounced was the superiority of Example 1 over Example 2 in abrasion resistance.

Various methods have been suggested and tried for measuring the abrasion resistance of nonwoven fabrics, such as the Chemstrand Aerodynamic Blanket Tester, wherein a fabric sample is caused to whirl in a circularly-revolving air stream in a closed container, the walls of which are lined with an abrading fabric. Alternatively, it has been proposed to affix the nonwoven fabric to the walls of this apparatus and to bombard it with small plastic or cork balls in the whirling air stream.

I have found, however, that a more realistic test, more readily correlated with the behavior of these nonwoven fabrics in actual use, is provided by a modification of the standard Crockmeter Tester, AATCC 8-1961 (AATCC Technical Manual, 1967, Howes Publishing Company, New York, Volume 43, page B-71).

In this test, a fabric-covered weight-loaded plastic foot is rubbed back and forth across a horizontally-mounted test specimen.

In order to speed up the abrasive action, the ⅝ inch diameter plastic foot was replaced by a foot 1½ inches in diameter. Also, since the woven fabrics suggested for a crocking test proved too gentle in abrasive action, the 1½ inch plastic foot was covered with a polyvinyl acetate-coated nylon scrim, J. P. Stevens style S/28018/1-100/101.

In such an abrasion test, Example 2 of U.S. Pat. No. 3,616,180 showed surface damage and separate of short-fibered covering from the substrate in 20 cycles. Example 1 survived 100 cycles with no sign of breakage or delamination. In a similar test, a commercially available disposable nonwoven, comprising a scrim adhesively laminated to a creped paper tissue, also failed after 25 cycles.

In a second set of experiments illustrating the process of this invention, a three-component assembly was prepared. The lowermost fleece was a light spunbonded web of substantially continuous synthetic filaments such as polypropylene, polyester, or polyamide. For handling purposes, it is preferred that the filaments of such spunbonded webs be bonded to each other at between 5% and 10% of their crossover points, which may for example be accomplished by an autogenous spot-bonding by heat and pressure during the formation of the spunbonded web.

Such spunbonded webs, being formed of continuous filaments in a randomly entangled and interlaced pattern, add a desirable element of crosswise strength to the products of this invention. However, they are generally so open and hydrophobic that they do not satisfactorily retain a layer of ultra-short fibers. It is preferred, therefore, that there be superimposed upon the spunbonded web a layer of fibers such as viscose rayon, weighing for example 10 to 15 grams per square yard.

The method of exhausting the binder onto the ultra-short fibers, and the application of the binder-coated ultra-short fibers onto the rayon fibers, were the same as in Example 1.

In the resulting structure, substantially all of the binder-coated ultra-short fibers remain on or near the uppermost layer of rayon fibers. Therefore in order to impart unity and coherence to the three-component composite, a secondary bonding operation was applied to the spunbonded web in the form of a set of printed transverse lines of a second polymeric binder, applied by passing the assembly over an engraved print roll with the spunbonded web contacting the roll. The printing was carried out in such a manner that at least a part of the second bonding agent penetrated through the spunbonded web and up into the overlying layer of rayon fibers. The other part of the binder provides strength, integrity and abrasion resistance to the bottom component, the spunbonded web.

Figure 4:
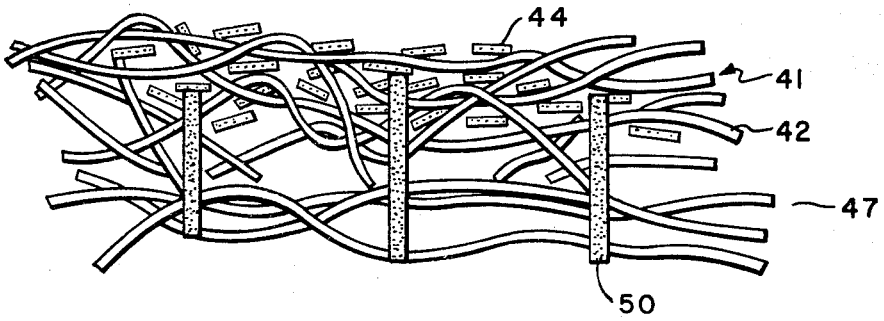
FIG. 4 is a cross-sectional representation of another product of the invention.

The composite product 41, shown more or less schematically in FIG. 4, comprises a spunbonded web of continuous filaments 47, a superimposed layer of rayon fibers 42, and a layer of binder-coated ultra-short fibers 44 intermingled with the rayon fibers 42 at and near the upper surface thereof. The spunbonded web is bonded into the structure by a set of transverse lines 50 of polymeric binder, applied to the lower (spunbonded) surface by an engraved print roll in a conventional manner.

It should be realized that for the sake of clarity of detail, only a few of the multiplicity of the fibers in these products are shown in FIGS. 2 and 4, and that the secondary bonding lines 45 and 50 are actually more diffuse than shown, due to inter-fiber capillarity. The structures shown in FIGS. 2 and 4 are therefore to be regarded as schematic and idealized rather than as restrictive.

In a third and similar experiment, the substrate was an air-laid web of unbeaten and unhydrated long paper-length fibers, ranging from 1,000 to 5,000 microns in length, dry deposited by the process of Canadian Pat. No. 813,290. The binder applied to the ultra-short fibers, and the method of application, were the same as in Example 1. The air-laid dry web weighed 40 grams per square yard before the deposition of the ultra-short fibers, which raised the weight of the fabric by 30 grams per square yard. The substrate web was then bonded by a line bonding operation applying 5 grams of that binder per square yard.

The final dried product had very good abrasion resistance and an opacity reading of between 80 and 85.

Essentially similar results were obtained when the above experiments were repeated using as a base substrate a mixture of one-third rayon fibers averaging 6 inches in length, two-thirds rayon fibers averaging one-quarter inch in length, the two fibers being intimately blended in an air-lay process. Mixtures of textile-length fibers and unbeaten and non-fibrillated fibers of 1,000 to 5,000 microns in length may also be used.

As mentioned above, the present invention has the advantage of allowing different binders to be used in the different species of fibers. Also, since the dry-laid substrate fibrous web is bonded in a separate operation, its softness and esthetic appeal may be further enhanced by distributing the selected binder not uniformly throughout the web, but in a set of discrete and spaced-apart lines extending transversely across the web, in the manner known in the art as "line bonding". Alternatively, it may be bonded by so-called "spot bonding", or by a set of broken transverse or oblique lines, by an overall diamond or lozenge print pattern, or by any of the other well-known and widely practiced patterns of discontinuous bonding. Either the binder associated with the ultra-short fiber fraction, or the binder associated with the substrate fiber fraction, may carry an associated dye or pigment, leading to patterns which differ on the two faces of the product. Also, it will be apparent that special auxiliary finishing agents, such as flame-retardants and the like, may be incorporated into one binder and one species of fiber but not into the other. Flame-retardants frequently have a stiffening effect on fabrics of all sorts: in this manner, it is possible to produce an opaque, abrasion-resistant and flae-retardant outer layer of ultra-short fibers on a soft and flexible inner layer of dry-laid fibers.

Also, by avoidance of the use of fibrillated or hydrated fibers, the products of this invention are characterized by a softness and drape factor which renders them exceptionally suitable for disposable garments, sheets, drapes and the like.

What is claimed is:

1. An abrasion-resistant nonwoven fabric comprising:

a bonded unspun and unwoven dry-laid fibrous web, substantially free from hydrated and fibrillated fibers;

at least one layer of substantially unbeaten and unhydrated ultra-short cellulosic fibers of between 50 and 300 microns in length adherent to at least one face of said web, said ultra-short fibers being coated with a first acrylic polymeric binder and said fibers in said web being bonded discontinuously along their length with substantial portions of their length being free of bonding agents by a second polymeric binder, said second polymeric binder being a different and firmer acrylic binder than said first binder and having more crosslinkage therein than said first binder.

2. The nonwoven fabric of claim 1 wherein the dry-laid fibrous web comprises a web of continuous filaments of a synthetic polymer with an overlay of textile-length rayon fibers.

3. The nonwoven fabric of claim 1 wherein the dry-laid fibrous web is an unspun and unwoven web of fibers of between one-quarter inch and six inches in length.

4. The nonwoven fabric of claim 1 wherein the dry-laid web comprises unbeaten and non-fibrillated fibers of between 1,000 and 5,000 microns in length.

5. The nonwoven fabric of claim 1 wherein the dry-laid web comprises a mixture of textile-length fibers of between one-quarter inch and 6 inches in length and unbeaten and non-fibrillated fibers of between 1,000 and 5,000 microns in length.

6. The nonwoven fabric of claim 2 wherein the web of continuous filaments and the overlay of rayon fibers are bonded to each other at a set of discrete and spaced-apart areas.

* * * * *